US005669803A

United States Patent [19]

Sweed

[11] Patent Number: 5,669,803

[45] Date of Patent: Sep. 23, 1997

[54] KICK GLIDER TOY

[76] Inventor: James Sweed, 12215 Wild Pine Apt. C, Houston, Tex. 77039

[21] Appl. No.: 532,166

[22] Filed: Sep. 22, 1995

[51] Int. Cl.[6] ..... A63H 27/00

[52] U.S. Cl. ..... 446/61; 446/26; 446/68; 244/154; 473/613

[58] Field of Search ..... 446/26, 61–68; D21/82–84, 87, 88, 89, 91; 244/16, 36, 153 R, 154; 473/613

[56] References Cited

U.S. PATENT DOCUMENTS

| | | | |
|---|---|---|---|
| D. 152,610 | 2/1949 | Green | D21/89 |
| D. 189,484 | 12/1960 | Ramniceanu | D21/87 |
| 1,775,252 | 9/1930 | Pennick | 446/66 |
| 2,483,614 | 10/1949 | Benson | 244/153 R |
| 2,630,321 | 3/1953 | Clyne | 446/61 |
| 3,547,384 | 12/1970 | Clark | 244/154 |
| 3,909,976 | 10/1975 | Kirk | 446/61 |
| 3,968,947 | 7/1976 | Schlegel et al. | 446/63 |
| 4,109,411 | 8/1978 | Wetherell et al. | 446/61 |
| 4,248,007 | 2/1981 | Gamburd | 446/66 |
| 4,307,536 | 12/1981 | English et al. | 446/67 |
| 4,911,383 | 3/1990 | Elson | 244/153 R |
| 4,997,401 | 3/1991 | Rose et al. | 446/64 |
| 5,090,636 | 2/1992 | Sadowski | 446/61 |
| 5,360,028 | 11/1994 | Jasin | 446/478 |

*Primary Examiner*—Robert A. Hafer
*Assistant Examiner*—Jeffrey D. Carlson

[57] ABSTRACT

A glider toy apparatus including a body member made of a resilient material, a wing member having a length greater than a width of the body member, and a weight member secured to the body member forward of the wing member. The wing member has a greater density than the body member. The body member is affixed centrally of the wing member. The wing member extends from the body member in a swept-back boomerang shape. The weight member is secured to the body forward of a center of gravity of the body member. A vertical stabilizer can be affixed to either the body member or to the wing member so as to extend upwardly therefrom.

4 Claims, 4 Drawing Sheets

FIG. 10
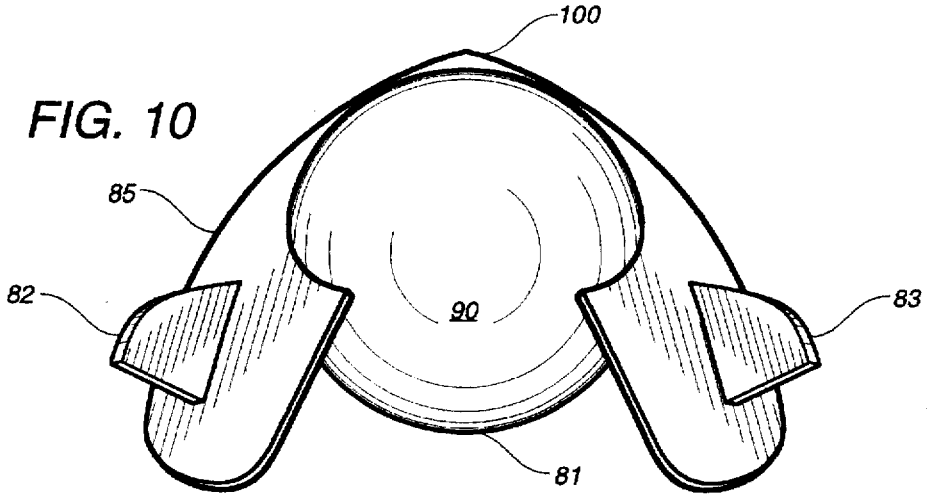
FIG. 11
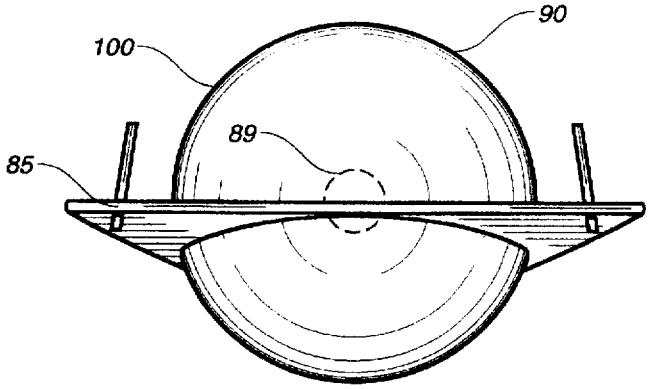
FIG. 12
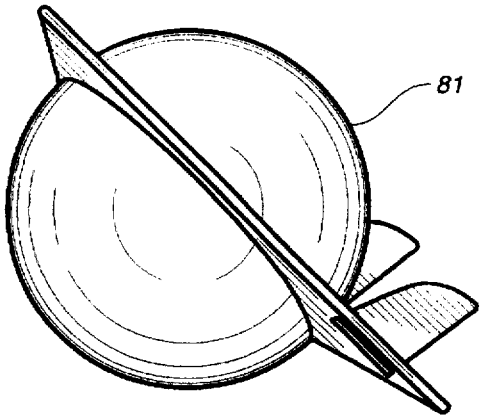
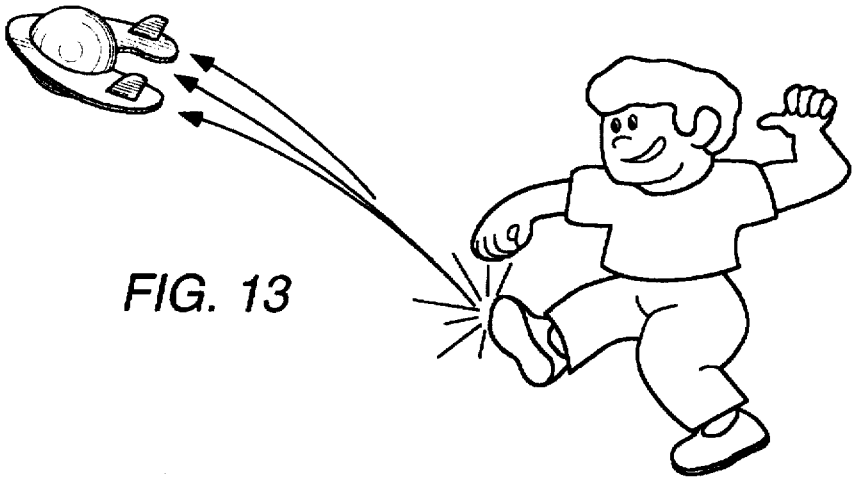
FIG. 13

KICK GLIDER TOY

TECHNICAL FIELD

This invention relates generally to the field of toys. More particularly, the present invention relates to a toy with aerodynamic properties which can be flown by either hand or by foot.

BACKGROUND ART

Toy gliders, typically launched by a hand-thrown fashion, offer a child little challenge and play quickly becomes stale and unexciting. While on the other hand, a toy glider flown in an unconventional way such as a kicking action of the foot, can provide new forms of athletic enjoyment and play for children and adults alike.

Some attempts have been made in the past to improve the aerodynamic characteristics of gliders. These, however, have been minimal due to the inadequate support capability of the wing configuration. Toy glider construction has been found to require very critical wing area and structure and very critical weight-to-balance tolerances. While many materials are available for the construction of gliders, few are available which provide the optimum structural integrity and weight combination.

In the past, various U.S. patents have issued relating to various types of glider toys and aerodynamic toys. These glider toys take on the configuration of an airplane or the configuration of a spherical or ball-like object.

With respect to airplane-shaped glider toys, various U.S. patents have issued on various types of designs. For example, U.S. Design Pat. No. 273,406, issued on Apr. 10, 1984 to A. G. Young and U.S. Design Pat. No. 310,251, issued on Aug. 28, 1990 to Kenyan describe toy gliders. U.S. Pat. No. 5,176,559, issued on Jan. 5, 1993, to S. Lane teaches a toy glider having a unitary wing formed of closed cell resin material and a weighted fuselage. U.S. Pat. No. 4,512,690, issued on Apr. 23, 1985, to M. E. Johnson describes a toy glider having a foam body with an opaque cape wing structure. Similarly, U.S. Pat. No. 4,109,411, issued on Aug. 29, 1978, to Wetherell et al. describes a toy glider including a body portion, a wing portion mounted on the body portion, and a pair of arms pivotally mounted on the body portion. U.S. Pat. No. 3,909,976, issued on Oct. 7, 1975, to N. A. Kirk teaches a glider toy made of a light weight, flexible and resilient material.

Various spherical or ball-shaped flying toys have been described in U.S. Pat. No. 5,338,027, issued on Aug. 16, 1994, to Rehkemper et al., in U.S. Pat. No. 4,616,827, issued on Oct. 14, 1986, to J. H. Bergland, in U.S. Pat. No. 4,262,911, issued on Apr. 21, 1981, to Opresik et al., and in U.S. Pat. No. 2,835,073, issued on May 20, 1958, to C. F. Dame.

U.S. Pat. No. 5,306,191, issued on Apr. 26, 1994, to Phillips et al. describes a cylindrical aerodynamic toy having ballast rings extending around the body. The toy is in the shape of a missile.

U.S. Pat. No. 3,008,263, issued on Nov. 14, 1961, to J. Ellman describes a model airplane which includes a central area for producing bubbles.

It is therefore desirable that improved toy gliders be available which offer increased interest and play value. It is, therefore, the primary object of the present invention to provide a novel toy glider structured to be principally launched with a kicking action of the foot in addition to the typical method of hand launching.

SUMMARY OF THE INVENTION

A toy glider embodying proper aerodynamic characteristics, having both lightweight body and wing portions, coupled with the fact that the leg is usually much stronger than the arm, enables even a small child to kick-launch glider for long distances.

The toy glider of the present invention is, preferably, made of a soft and resilient open-cell material.

The wing portion comprises a relatively thin sheet of flexible light weight closed cell material, such as foam, which is bendable and has shape-retaining properties. The wing portion has a width appreciably greater than the width of the body portion. The wing portion has a greater thickness and density than the body member. The wing portion extends from either side of the body in a swept back boomerang manner. Various other materials and shapes may, of course, be employed.

The fuselage or body member is designed to contain the kicking foot of the user. The body member is a hollow shell defined by a thin outer skin with large open rear channel to receive and house the kicking foot.

The surface of the body portion has a generally cylindrical or curved surface (i.e. a semi-frustoconical configuration) which is aligned with the flat inner surface. This structure in the form of a hollow conical-shaped dome facilitates placement of the kicker's foot.

The body portion, formed of a sheet of closed cell elastomeric material, possesses optimum flexibility and compressibility so to accommodate a variety of foot sizes. This sheet is formed into a semi-frustoconical conical form with two of the opposite edges being brought together and secured to the wing surface to form a lightweight short length tube. The sheet may be formed by cutting a square sheet and then bending the sheet to superimpose the equi-angular corners one upon the other so as to form a tube. Alternatively, the tubular body could be integrally molded to such a shape.

The body portion is supported on top of the wing member structure. It is arranged to have symmetry with respect to the width of the wing structure. The tapered inclined front of the body portion, in conjunction with its curved outer end, forms a continuous surface which enhances the glider's aerodynamic qualities while presenting minimal air resistance.

Centrally mounted on the top surface of hollow body portion is the vertical stabilizer, or more commonly referred to as the tail. This is secured to the body portion by any suitable form of bonding, gluing, or the like, such as a slot. The stabilizer can mount to alternate locations on the glider as well. For example, two stabilizers could be sufficiently placed on the wing surface, one on each end or be altogether omitted where adequate wing structure and adequate dihedral may be formed in the wing structure.

The leading edge of the area of the glider, commonly known as the nose, is fitted with a ballast (or weight member) to give the structure additional weight at the forward end. The ballast provides an appropriate lift force vector relative to the center-of-gravity as the glider is kicked into flight and protects the leading edge central portion of wing from damage. This weight member can be constructed from a rigid material, rubber, or synthetic resilient plastic material, for example. The weight member is affixed to glider's leading edge as securely as possible.

The manufacture of this unique glider is relatively simple and uses relatively inexpensive material. This cost of this glider is competitive with other gliders so not to deter consumers from buying it, particularly since it is novel in both appearance and function, and easily employed by even a very young child.

The glider toy can take on fanciful designs including that of animal appendages so as to enhance the attractiveness of the toy to children.

BRIEF DESCRIPTION OF THE DRAWINGS

FIG. 10 is a further embodiment of the present invention illustrated in which shows a spherical configuration of the fuselage.

FIG. 11 is a front view of the embodiment of the present invention of FIG. 10.

FIG. 12 is a side view of the glider shown in FIG. 10.

FIG. 13 is a perspective view of the glider of FIG. 10 in flight after receiving a kick by a child.

DETAILED DESCRIPTION OF THE INVENTION

Figure 1:
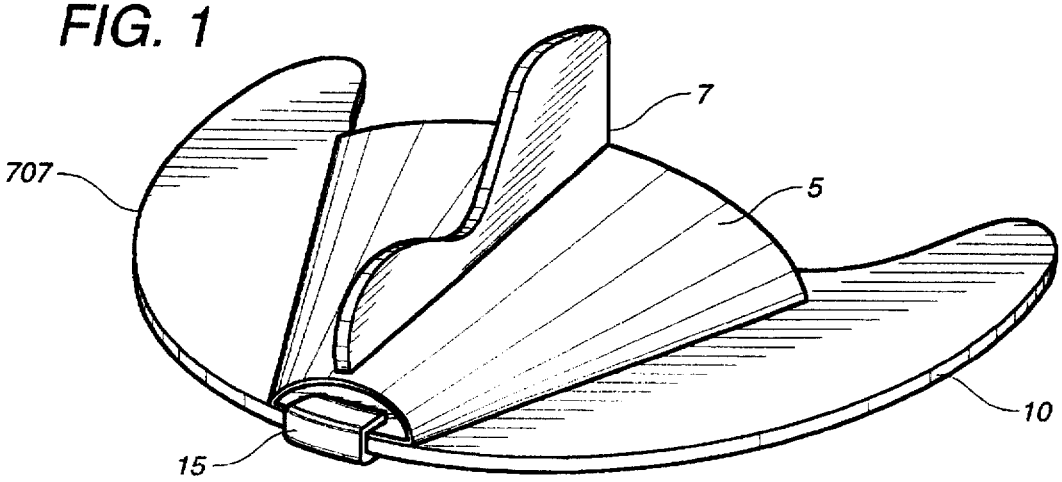
FIG. 1 is a front elevational view of the preferred embodiment of the kick launch glider of the present invention.

The primary form of the glider toy 707, as seen in FIGS. 1–6, comprises a hollow open end body member 5 that is situated on top of wing member 10. The leading edge of wing member 10 is protected by a weight member 15 which is secured to the leading edge. A vertical stabilizer tail 7 is mounted to the top of the body member 5.

The unitary wing member 10 is formed of a relatively stiff, yet flexible, closed-cell material with shape-retaining properties. The wing member 10 has a density greater than the body member 5. A portion of the wing is occupied by the body member 5 arranged to have symmetry with respect to the width of the wing. The body member 5 is secured to wing member 10 by glue or it can be molded as a single piece. The weight member 15 is mounted to the leading edge of wing member 10. The weight member serves as protection for the leading edge as well as proving additional thrust and momentum when the glider toy 707 is kick-launched.

Figure 2:
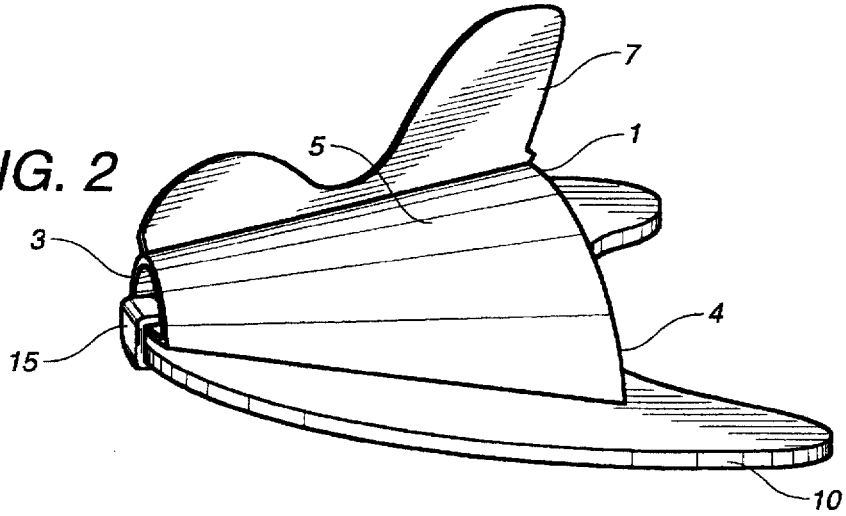
FIG. 2 a side elevational view of the illustration of FIG. 1.

The body member 5 is constructed of a thin compressible resilient material. As seen in FIG. 2, body member 5 is tapered at front end 3 and broadens out greatly at back end 4. The inclined top surface of the body member 5 in conjunction with its curved form 1 presents minimum air resistance and enhances the glider's aerodynamic qualities.

Figure 3:
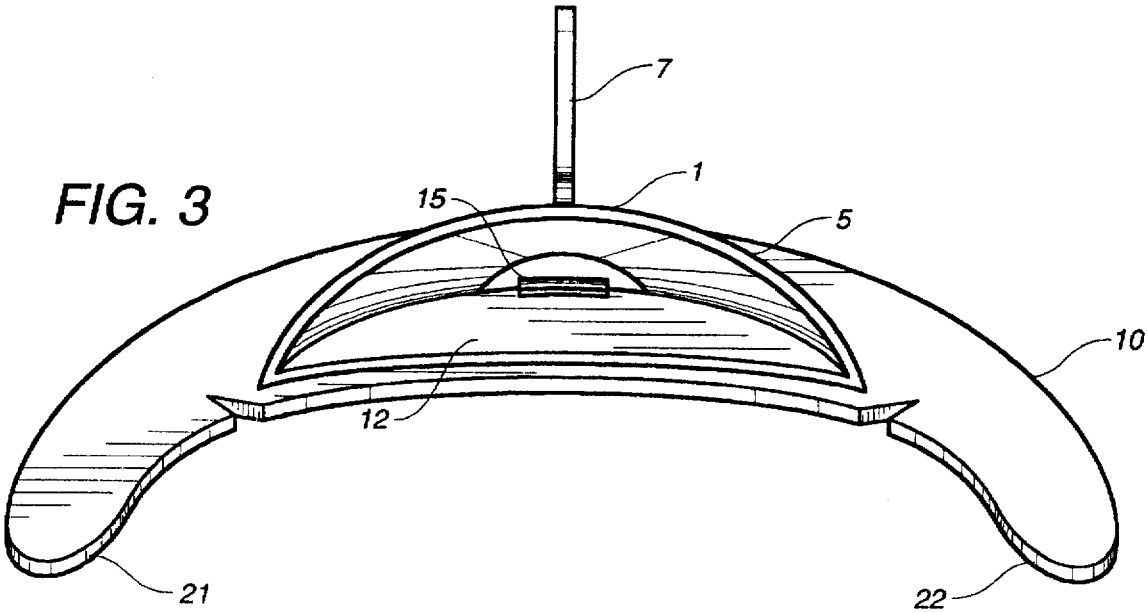
FIG. 3 is a rear elevational view of the glider shown in the present invention.

FIG. 3 illustrates the flat inner surface 12 of the body member 5 which is aligned with the curved top surface 1. The body member 5 formed of an open-cell foam material. It is easily bendable and will yield when it strikes an object. The body member 5 will immediately return to its original shape after it strikes an object. Body member 5 is secured on wing member 10 centrally between the trailing edges 21 and 22 of wing.

Centrally mounted on the top of body member 5 is the vertical stabilizer 7. The stabilizer 7 is secured by means of gluing, bonding, or the like, such as a slot. The stabilizer 7 can mount to the wing surface as well, or be omitted where adequate wing structure and adequate dihedral may be formed in the wing structure.

Glider toy 707 further includes a weight member 15 which can be constructed of a rigid material, rubber, or a synthetic resilient plastic material, for example. The weight member 15 is secured to the front of body member 5 and leading edge of wing member 10 to assist in protecting it from damage. The weight member 15 is rigidly attached along the flat portion of the inner surface 12 of the body member 5 and the leading edge of the wing member 10. The weight member 15 is also attached to a portion of the underside of wing, located forward of the center of gravity of glider toy 707.

Figure 4:
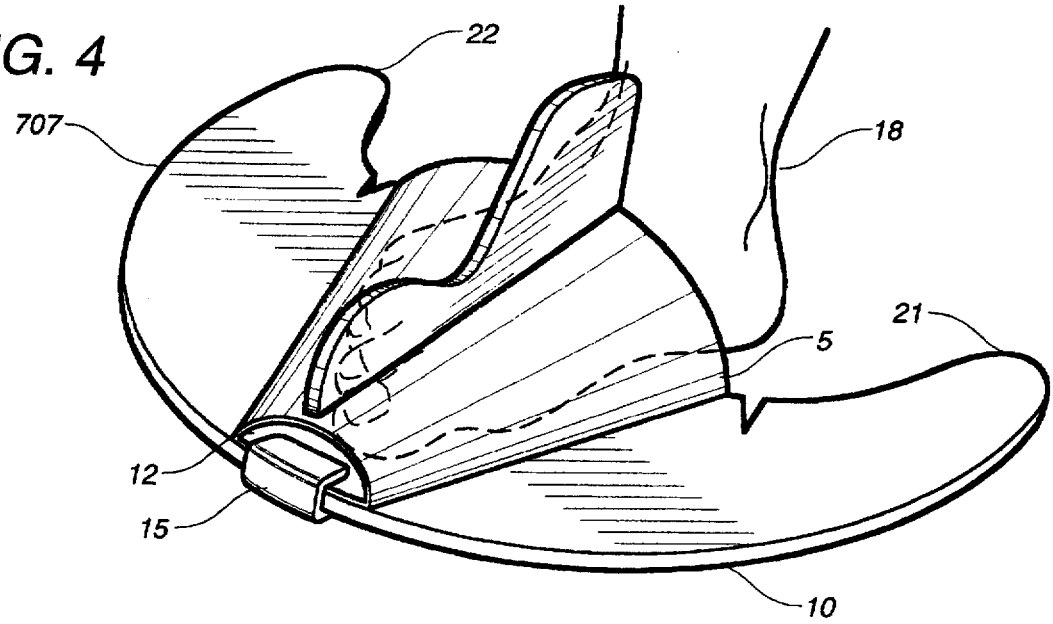
FIG. 4 is a perspective view of the glider toy which illustrates the manner in which kicking foot is placed into the fuselage.

There is depicted, in FIG. 4, a glider toy 707 having kicking foot 18 positioned inside hollow body member 5 centrally located between flat inner surface 12 and top curved surface 1 and trailing edges 21 and 22 of wing member 10. Glider toy 707 is shown in its preflight station prior to launch.

Figure 5:
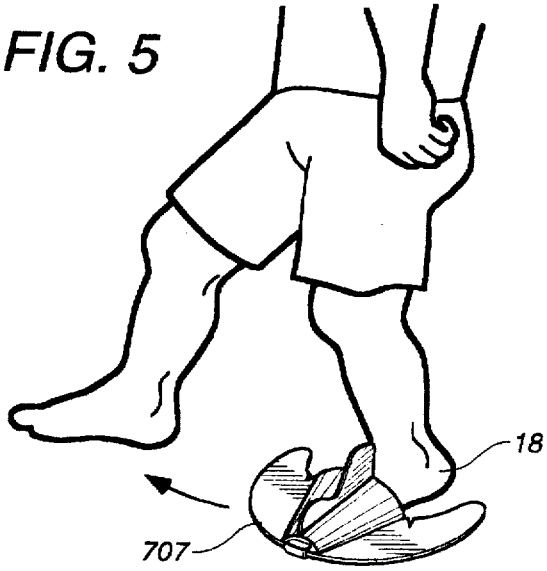
FIG. 5 is a perspective view of the glider toy as it is held for use and begins to move forward just prior to its launch.
Figure 6:
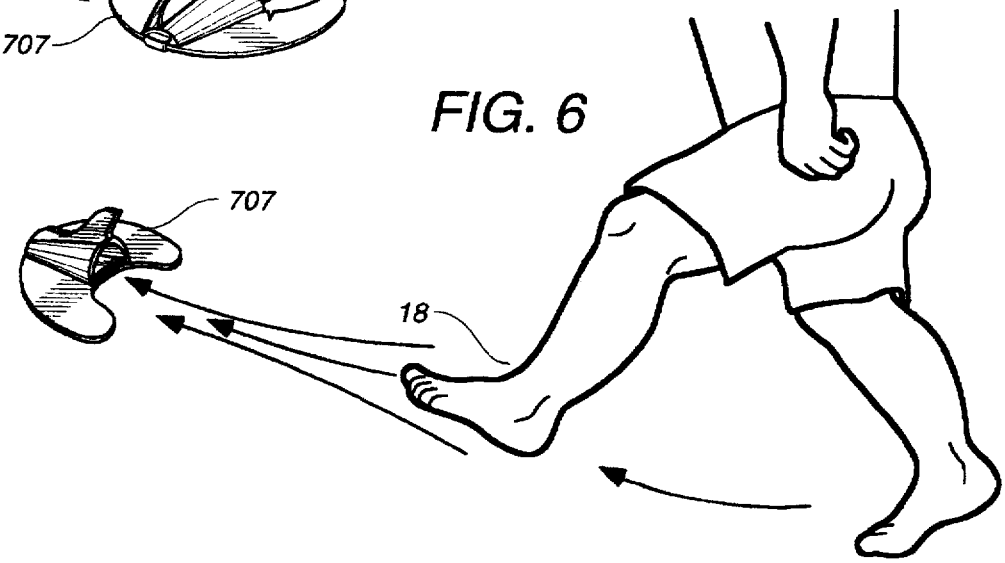
FIG. 6 is a perspective view illustrating the completed kick-to-launch sequence and consequent launch of the glider through the air.

FIG. 5 illustrates the glider toy 707 as it is moved from a stationary position after the lead foot procures a step forward with kicking foot 18 with Glider toy 707 closely trailing. The glider toy 707 is thrust forward into the air in a kicking action as shown in FIG. 6. The glider toy 10 is dislodged from the foot 18 so as to soar into free flight.

Figure 7:
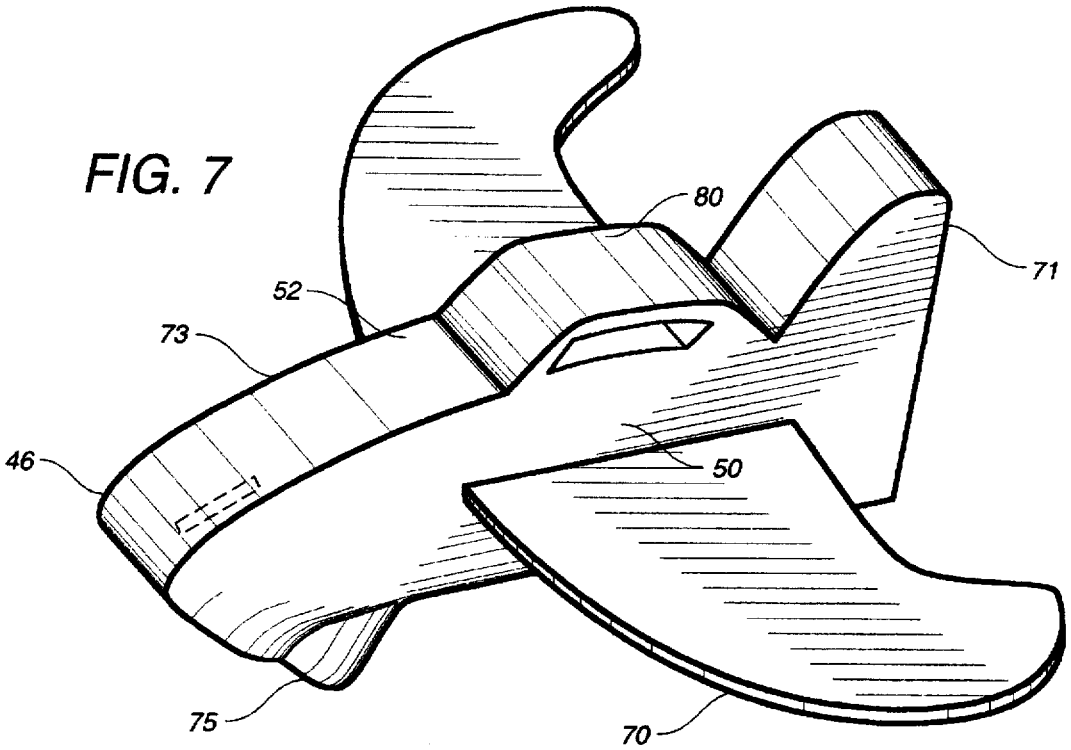
FIG. 7 is a perspective view of an alternate embodiment of the present invention illustrated in FIG. 1.

FIG. 7 illustrates another embodiment of the invention shown in FIG. 1. The embodiment of FIG. 7 is designed to accommodate a kicking action from the foot as one manner to initiate flight. Glider toy 80 is substantially symmetrical about a longitudinal axis or centerline extending through the central portion of glider toy 80. The front to rear center of gravity of the glider is located approximately at the protrusion 75 that extends downward from underneath the nose area. Glider toy 80 generally comprises a central body member 73 with wing 70 and terminating in a broad rear tail surface 71. Wing member 70 extending from either side of body member 73 and is symmetrical about a glider centerline extending longitudinally and centrally through body member 73 between wing member 70.

Figure 8:
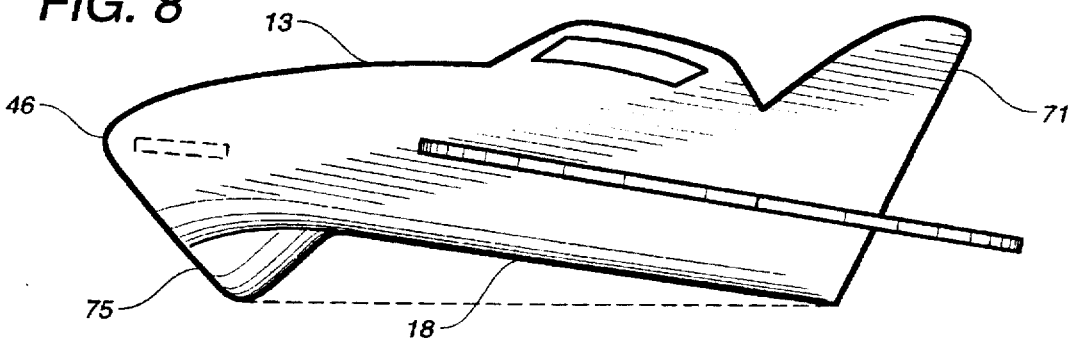
FIG. 8 is a side view of the alternative embodiment of the glider toy of FIG. 7.

Referring to FIGS. 7 and 8, the body member 73 includes an upper surface 13 and a raised lower surface 18 which is the bottom side of body member 73. A pair of angled side surfaces 50 and 52 extend between the upper surface 13 and the lower surface 18. A nose portion 46 defines the forward-most edge of glider toy 80.

Referring to FIG. 8, an upward step, shown generally at 75, has a forward location. The step 75 is formed in the underside of glider toy 80 and is symmetrical about the glider's centerline. The purpose of step 75 is to raise undersurface 18 so as to lessen contact with the ground so to facilitate unobstructed forward movement of glider toy 80 during take-offs. The broad vertical rear tail surface 71 is substantially flat and is aptly adapted to receive the force of a kick to launch glider toy 80 into flight.

The leading edge of nose portion 46 is embedded with a ballast as shown by the broken lines in FIGS. 7 and 8. This ballast provides an appropriate lift force vector critical to the weight balance ratio for desired flight characteristics.

Figure 9:
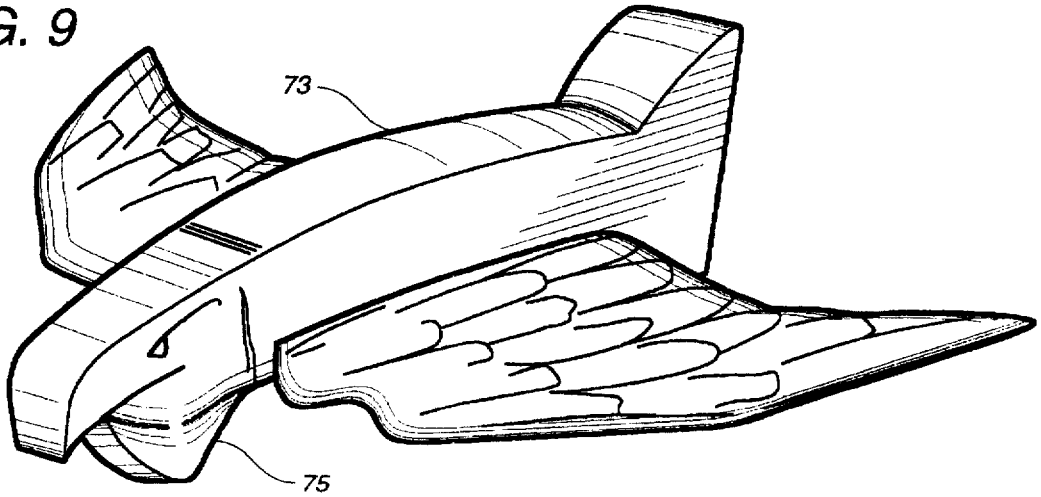
FIG. 9 is a perspective view of the glider toy of FIG. 7 having appendages extending therefrom in the form of bird wings and a bird head portion.

FIG. 9 illustrates the invention of FIG. 7 formed such that its nose area 46 and wing member 70 resembles that of a flying bird. The underside of body member 73 is structured in like manner with protrusion 75 designed to raise the underside as in FIGS. 7 and 8.

FIG. 10 is a rear elevational view of an alternative embodiment of the kick-to-fly glider. This glider 100 is shown with a spherical fuselage. Wing member 85 is attached around circumference of spherical body member 81. Vertical stabilizers 82 and 83, one on each wing end, are attached to the surface of wing member 85. FIG. 11 shows that a weight member 89 is positioned internally or externally to the front portion of kick ball glider 100 at a location in which the center of gravity of the weight member 89 is forward of the center of gravity of the glider toy 100 as a whole.

The spherical body member 81 is constructed of a thin resilient skin which forms the outer shape of the ball. The body member 81 has a hollow core which can be inflated with air through a valve entry. Alternatively, a ball glider 100 can be formed of a sponge rubber-like core to provide inherent bounce to the kick ball glider. The glider 100 is launched by a kick of the foot.

FIG. 10 is a elevational view of the back surface between wing ends which serves to receive the force from a kick launch. The strike surface 90 is made of shock absorbent material that is able to tolerate repeated kicking. The front of spherical body member FIG. 11 is circumferenced by wing member 85. The arrangement of the wing member 85 on body member 81 will also prevent the glider from rolling away after landing.

Extending from the circumferential surface of spherical body member 81 is the wing member 85. After body member 81 is kicked forward on the strike surface 90 so as to initiate flight, passage through the air creates aerodynamic forces upon the flat wing surfaces varying lift, yaw, and pitch forces which are transferred over the glider. These varying aerodynamic forces provide a general unpredictable and variable flight pattern for the spherical kick glider toy.

The kick-ball glider 100 in its preflight position naturally rest on the wing ends as shown in FIG. 12. The glider 100 is in a rolled back position which facilitates easy access to strike surface 90.

Each of the embodiments of the invention are made of a rubber, or rubber-like composition, or a soft foam, or a pliable plastic material. The material should be selected to provide a degree of malleability to the glider such that it can be hit with a kicking action of the foot, or flung from said body member, and at the same time not to injure someone if the glider toy accidentally strikes a part of the body.

It is the primary object of the present embodiment of the invention to provide a spherical glider toy 100 which can fly just as well when kick-launched as when thrown by hand.

The vertical stabilizers 82 and 83 on the wing surface in conjunction with its delta shape wing 85 causes the kick-ball glider 100 to fly through the air in a relative straight pattern unlike the spinning motion of other spherical toy objects.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A glider toy apparatus comprising:

a body member made of a resilient material, said body member having a generally hollow semi-frustoconical configuration, said body member having an open rear end which is sized to receive a human foot therein, said body member having a curved top surface, said body member having an open forward end;

a wing member having a length greater than a width of said body member, said body member affixed generally centrally of said wing member, said wing member having a greater density than said body member, said wing member extending from said body member in a swept-back boomerang shape, said body member having a flat surface secured to a top surface of said wing member; and a weight member secured to said body member forward of a trailing edge of said wing member and forward of a center of gravity of said body member, said weight member affixed to an inner surface of said body member at said open forward end, said weight member affixed to an underside of said wing member.

2. The apparatus of claim 1, further comprising:

a vertical stabilizer affixed to a top surface of said body member.

3. The apparatus of claim 1, said trailing edge of said wing member extending rearwardly of said open rear end.

4. The apparatus of claim 1, said wing member being of flexible closed-cell shape-retaining material.

* * * * *